US007299650B1

(12) United States Patent
Romanos et al.

(10) Patent No.: US 7,299,650 B1
(45) Date of Patent: Nov. 27, 2007

(54) DRY CRYOGENIC SHIPPING CONTAINER

(75) Inventors: John Lawrence Romanos, Mobile, AL (US); Norman Braxton Breighner, Theodore, AL (US)

(73) Assignee: Harso Technologies Corporation, Fairmont, MN (US)

( * ) Notice: Subject to any disclaimer, the term of this patent is extended or adjusted under 35 U.S.C. 154(b) by 253 days.

(21) Appl. No.: 11/257,936

(22) Filed: Oct. 25, 2005

(51) Int. Cl.
*F25D 3/08* (2006.01)

(52) U.S. Cl. ..... 62/371; 62/457.1; 62/457.2

(58) Field of Classification Search ..... 62/47.1, 62/46.1, 51.1, 45.1, 60, 100, 457.1, 476, 62/457.2, 268, 465; 220/560.04, 560.1, 901; 248/636

See application file for complete search history.

(56) References Cited

U.S. PATENT DOCUMENTS

| | | | | | |
|---|---|---|---|---|---|
| 1,651,655 | A | * | 12/1927 | Fairfax et al. | 220/592.27 |
| 2,210,946 | A | | 8/1940 | Moore | |
| 3,274,788 | A | * | 9/1966 | Hoffman et al. | 62/45.1 |
| 3,747,365 | A | * | 7/1973 | Nicholds | 62/51.2 |
| 4,259,846 | A | * | 4/1981 | Rudolphi et al. | 62/46.3 |
| 4,745,761 | A | | 5/1988 | Bazaj et al. | |
| 4,827,736 | A | * | 5/1989 | Miura et al. | 62/51.1 |
| 4,872,321 | A | * | 10/1989 | Buchanan | 62/51.1 |
| 4,925,060 | A | * | 5/1990 | Gustafson | 220/371 |
| 5,177,981 | A | * | 1/1993 | Haas | 62/457.3 |
| 5,317,879 | A | * | 6/1994 | Goldberg et al. | 62/51.1 |
| 5,355,684 | A | * | 10/1994 | Guice | 62/54.2 |
| 5,381,666 | A | | 1/1995 | Saho et al. | |
| 6,119,465 | A | | 9/2000 | Mullens et al. | |
| 6,539,726 | B2 | * | 4/2003 | Giesy et al. | 62/48.1 |
| 6,655,156 | B1 | * | 12/2003 | Miksic et al. | 62/48.1 |
| 2002/0113070 | A1 | * | 8/2002 | Emmel | 220/560.1 |

FOREIGN PATENT DOCUMENTS

| | | | |
|---|---|---|---|
| EP | 0326967 | A2 * | 8/1989 |

* cited by examiner

*Primary Examiner*—Mohammad M. Ali
(74) *Attorney, Agent, or Firm*—David C. Jenkins; Eckert Seamans Cherin & Mellott, LLC

(57) ABSTRACT

A dry cryogenic shipping container having a removable absorbent assembly is provided. The dry cryogenic shipping container is structured to be a Dewar's flask having a first, outer shell assembly, and second, inner shell assembly disposed within and spaced from the first, outer shell assembly, and a cap. Within the shipping container is an absorbent assembly having a body with a central cavity. The absorbent assembly body is formed by a plurality of removable absorbent assembly elements. That is the absorbent assembly elements are sized to pass through the passage into the space within the shipping container. As such, after use, the absorbent assembly body elements may be removed and the remaining components may be sterilized. After sterilization, new absorbent assembly body elements are inserted into the inner space and the dry cryogenic shipping container is used again.

12 Claims, 4 Drawing Sheets

DRY CRYOGENIC SHIPPING CONTAINER

BACKGROUND OF THE INVENTION

1. Field of the Invention

This application relates to a dry cryogenic shipping container and, more specifically, to a dry cryogenic shipping container having a removable absorbent.

2. Background Information

Cryogenic shipping containers are used to transport materials at temperatures well below the freezing point of water. The materials transported at cryogenic temperatures are typically biologically active, such as, but not limited to, tissue samples and microorganism cultures. Hereinafter these materials will be identified as "use materials." The typical cryogenic shipping container, similar to many storage devices for cryogenic liquids, included a Dewar flask, or similar construct, having an outer shell, an inner shell, and a vacuum therebetween. The inner and outer shells were coupled at a neck which defines a passage into the interior of the inner shell. A shipper core, typically a hollow cylinder, was disposed within, and coupled to, the inner shell. The inner shell had an inner diameter that was greater than the diameter of the shipper core. Thus, there was an annular gap between the shell and the shipper core. The shipper core may have also included a support structure for holding another containment device, such as, but not limited to, a canister or sample container.

When prepared for transport or storage, a cryogenic shipping container included a use material disposed in a sample container, which in turn was contained in a removable canister. The canister was then disposed in the shipper core. The shipper core, as noted above, was coupled to the inner shell. A cryogenic liquid was disposed in the annular gap between the shell and the shipper core. The container was closed by an insulated cap as was known in the art. This basic configuration, while useful, allowed cryogenic liquid to slosh about within the inner shell. Such a fluid movement is undesirable as it enhanced evaporation; the cryogenic liquid could splash on the use material, and cryogenic liquids can be dangerous to touch. Additionally, certain cryogenic liquids are prohibited from certain forms of transportation, such as air shipping.

To reduce the amount of free cryogenic liquid in a cryogenic shipping container, absorbent materials were disposed in the annular gap. The absorbent materials were typically a rigid foam or another moldable material that could be disposed within the inner shell while maintaining a cavity sized to accept the shipper core. This absorbent material was, effectively, sealed in the inner space of the inner shell when the shipping core was coupled to the inner shell. In operation, the cryogenic liquid was poured into the inner space and allowed to be absorbed by the absorbent material. Any excess cryogenic liquid was removed prior to placing a sample container in the shipping core. As the cryogenic liquid was trapped in the absorbent materials, this type of cryogenic shipping container was identified as a "dry" cryogenic shipping container.

The disadvantage to using the dry cryogenic shipping container is that the absorbent material may become contaminated by the use materials. Once the absorbent materials become contaminated, the cryogenic shipping container should not be used again. Thus, the relatively expensive cryogenic shipping container may be rendered useless due to the contamination of the relatively inexpensive absorbent material.

There is, therefore, a need for a dry cryogenic shipping container that may be reused.

There is a further need for a dry cryogenic shipping container having a removable absorbent material.

SUMMARY OF THE INVENTION

These needs, and others, are met by the present invention which provides a dry cryogenic shipping container having a removable absorbent material. The structure of the metal components of the dry cryogenic shipping container remains generally similar to the dry cryogenic shipping container of the prior art. That is, the metal components are structured to be a Dewar's flask having an outer shell, an inner shell disposed within and spaced from the outer shell, and a cap. The outer shell and inner shell define a plenum wherein a vacuum is pulled. The inner shell defines an inner space. The outer shell and inner shell are coupled to each other at a neck that defines a passage into the inner space. Within the inner space is an absorbent assembly having a body with a central cavity. The absorbent assembly body is formed by a plurality of removable absorbent assembly elements. That is the absorbent assembly elements are sized to pass through the passage into the inner space. As such, after use, the absorbent assembly body elements may be removed and the remaining components may be sterilized. After sterilization, new absorbent assembly body elements are inserted into the inner space and the dry cryogenic shipping container is used again.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein the phrase "sterilizable material" means a material that may be substantially sterilized either by heat, a chemical agent, radiation, or a combination thereof.

As used herein, the word "sample container" shall mean any container, such as, but not limited to, a vial or straw, used to store or transport a use material.

As used herein, the word "absorbent" shall mean a material that takes up another material, including an adsorbent material.

Figure 2:
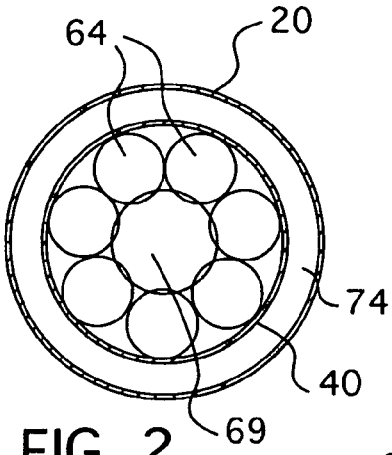
FIG. 2 is a top view of a dry cryogenic shipping container.
Figure 1:
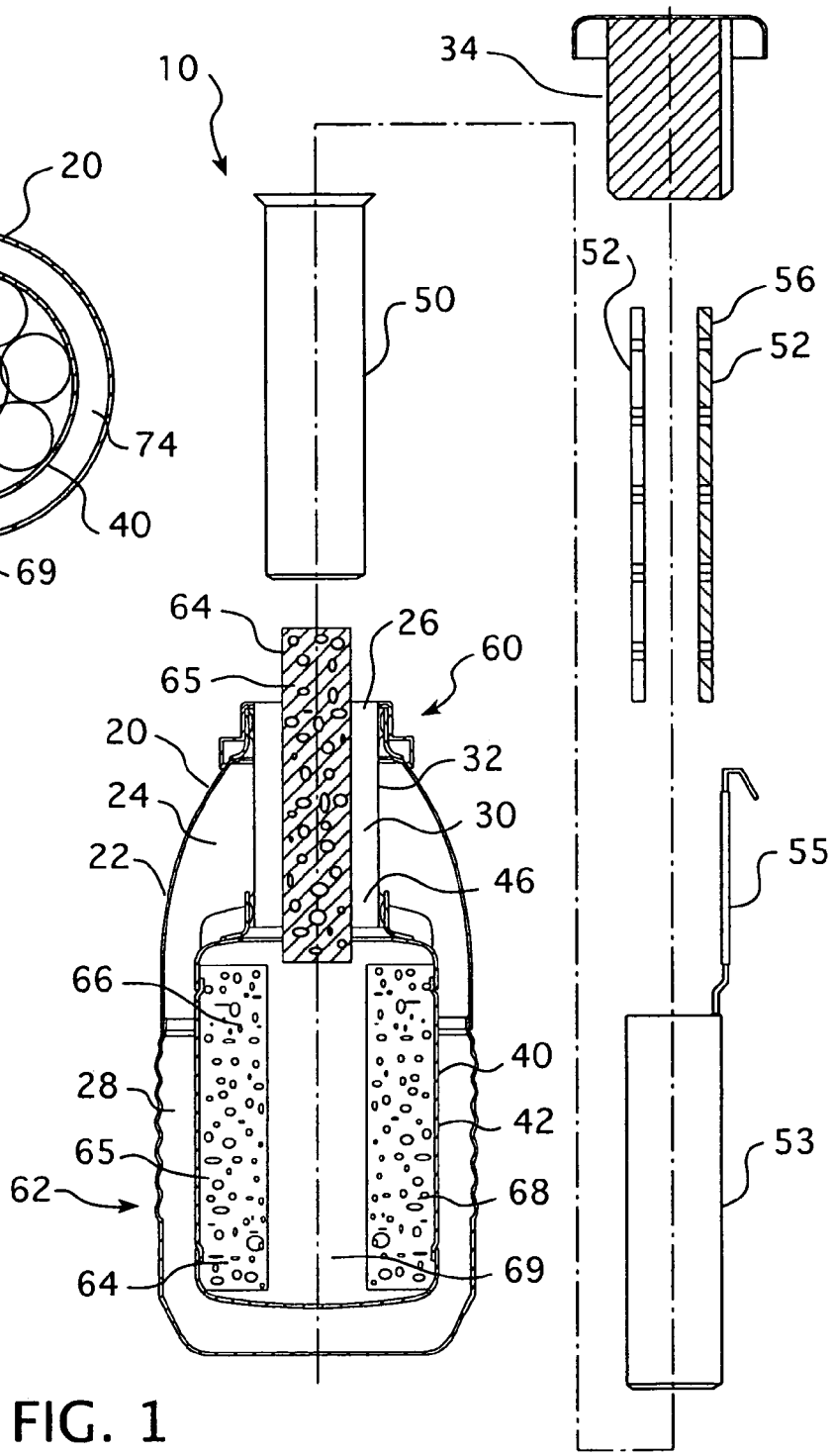
FIG. 1 is a side exploded view of a dry cryogenic shipping container.

As shown in FIG. 1, a shipping container 10 includes a first, outer shell assembly 20, a second, inner shell assembly 40, and an absorbent assembly 60. The first, outer shell assembly 20 has a body 22 defining an enclosed space 24 and having an opening 26. The second, inner shell assembly 40 has a body 42 defining an inner space 44 and having an opening 46. The second, inner shell assembly body 42 is disposed within, and generally spaced from, the first, outer shell assembly body 22, thereby forming a generally airtight plenum 28 within the enclosed space 24. A vacuum is pulled in the plenum 28. The second, inner shell assembly body 42 and the first, outer shell assembly body 22 are coupled together at the openings 26, 46, thereby forming a passage 30 into the inner space 44. There may be an elongated tube, or neck 32, extending between the first, outer shell assembly opening 26 and the second, inner shell assembly opening 46 that defines the passage 30. The first, outer shell assembly 20 further includes an insulated cap 34 structured to close the passage 30. The first, outer shell assembly 20 and the second, inner shell assembly 40 are made from a sterilizable material such as, but not limited to, stainless steel or aluminum. In this configuration, the outer shell assembly 20 and the inner shell assembly 40 form a Dewar's flask.

The second, inner shell assembly 40 may further include a shipper core 50. The shipper core 50 is a removable container sized to pass through the passage 30. The shipper core 50, preferably, has a length sufficient to extend between the bottom of the second, inner shell assembly body 42 and partially into the passage 30 so that the shipper core 50 does not fall into the inner space 44. The shipper core 50 further is structured to support a sample container 52, or a support structure 54 in which a sample container 52 may be stored. The support structure 54 is typically, but is not limited to, a canister 53 or a hollow cane 56 (both described below). Thus, a sample container 52 of use material may be disposed in the shipper core 50, which is, in turn, disposed within the second, inner shell assembly body 42. The passage 30 may then be sealed by the cap 34 thereby substantially thermally insulating the use material.

Preferably, the shipping container 10 has a generally elongated, cylindrical shape. The first, outer shell assembly body 22 has a generally cylindrical lower portion 70 having a first diameter and a tapered upper portion 72 wherein the diameter reduces to be adjacent to the neck 32. The second, inner shell assembly body 42 is generally cylindrical having a second diameter. The second, inner shell assembly body 42 diameter is smaller than the lower portion 70 diameter. The neck 32 is generally cylindrical having a third diameter that is, preferably, smaller than the second, inner shell assembly body 42 diameter. That is, to maximize the storage space within the inner space 44, the second, inner shell assembly body 42 diameter is larger than the diameter of the neck 32. The shipper core 50 is also cylindrical, preferably, having a diameter that is almost the same size of the neck 32. In this configuration, the shipper core 50 has a cross-sectional area that is less than the cross-sectional area of the second, inner shell assembly body 42. Thus, in the preferred embodiment, with the shipper core 50 disposed in the inner space 44, there is an annular space 74 between the shipper core 50 and the second, inner shell assembly body 42. The absorbent assembly 60 is disposed in the annular space 74.

The absorbent assembly 60 has a plurality 62 of removable absorbent elements 64. In the preferred embodiment, the absorbent elements 64 are socks 65. The socks 65 are elongated, preferably a generally cylindrical body having a cross-sectional area sufficiently small enough to pass through the passage 30. Each sock 65 includes a flexible covering 66, which may be fabric, and a granular filler material 68. The filler material 68 is, preferably, made from fumed silica or another absorbent/adsorbent material. The socks 65 have a length sufficient to extend between the bottom of the second, inner shell assembly body 42 to a level just below the passage 30. The plurality 62 of absorbent elements 64 include a number of socks 65 sufficient to substantially fill the inner space 44 except for a cavity 69 about the size of the shipper core 50. That is, the socks 65 are individually installed into the inner space 44 and moved to be adjacent to the second, inner shell assembly body 42, that is, into the annular space 74, thereby leaving a cavity 69 generally aligned with the passage 30. That is, the cavity 69 is disposed generally along the longitudinal axis of the inner shell assembly 40. The shipper core 50 is then inserted into the cavity 69. Prior to insertion of the shipper core 50, the socks 65 may extend into the space to be occupied by the shipper core 50. During the installation of the shipper core 50, however, the shipper core 50 will contact any socks 65 extending into the space to be occupied by the shipper core 50 and, due to the nature of the flexible covering 66, move the socks 65 out of the space to be occupied by the shipper core 50. This compression of the socks 65 also acts to squeeze the socks 65 together thereby reducing any gaps between the socks 65. When the shipper core 50 is installed, the socks 65 fill substantially all of the annular space 74.

Figure 3:
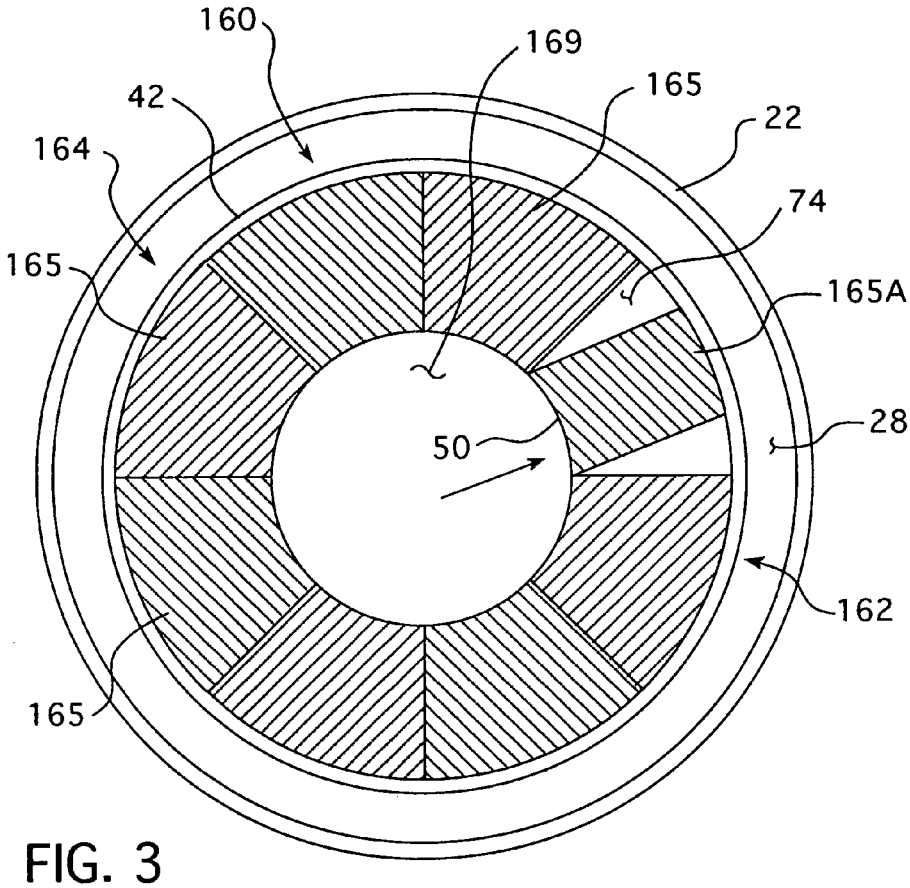
FIG. 3 is top cross-sectional view of an alternate dry cryogenic shipping container.

In an alternate embodiment, shown in FIG. 3, the absorbent assembly 160 includes a body 162 formed of removable absorbent elements 164 that are generally rigid members 165. The rigid members 165 are structured to form a cavity 169 generally aligned with the passage 30. The cavity 169 is sized to accommodate the shipper core 50. Each rigid member 165 is sized to pass through the passage 30. Thus, the absorbent assembly body 162 may be removed from, or installed in, the inner space 44. The rigid members 165 are structured to absorb a cryogenic liquid and are, preferably, made from fumed silica or another absorbent/adsorbent material. Again, the absorbent assembly body 162 is disposed in the annular space 74. The rigid members 165 therefore are preferably shaped as elongated, truncated wedges with a generally circular outer edge and a generally circular inner edge. That is, to use a baked goods analogy, the rigid members 165 are shaped as pieces of a doughnut that has been cut into pie slices. This shape allows the rigid members 165 to be inserted through the passage 30 and assembled into the absorbent assembly body 162 within the inner space 44. As shown in FIG. 3, as the last rigid member 165A to be installed must be moved radially to be installed, the last rigid member 165A is shaped as a quadrilateral sized to fit between adjacent wedge-shaped rigid members 165.

Figure 4:
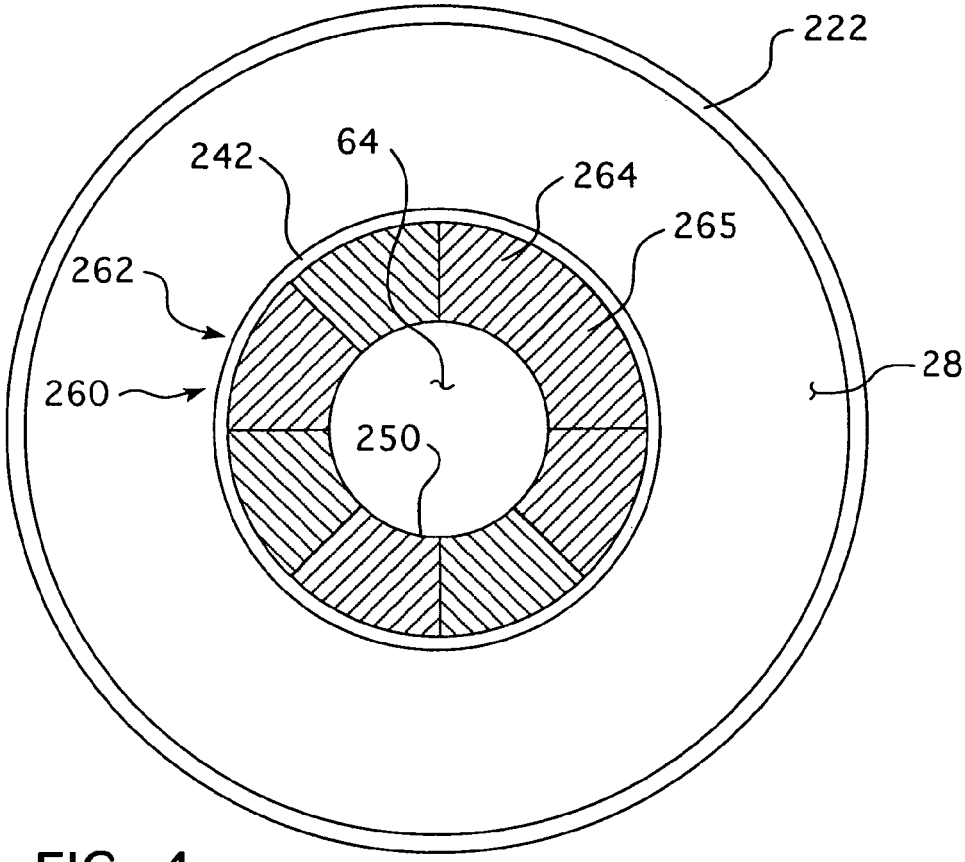
FIG. 4 is top cross-sectional view of another alternate dry cryogenic shipping container.
Figure 5:
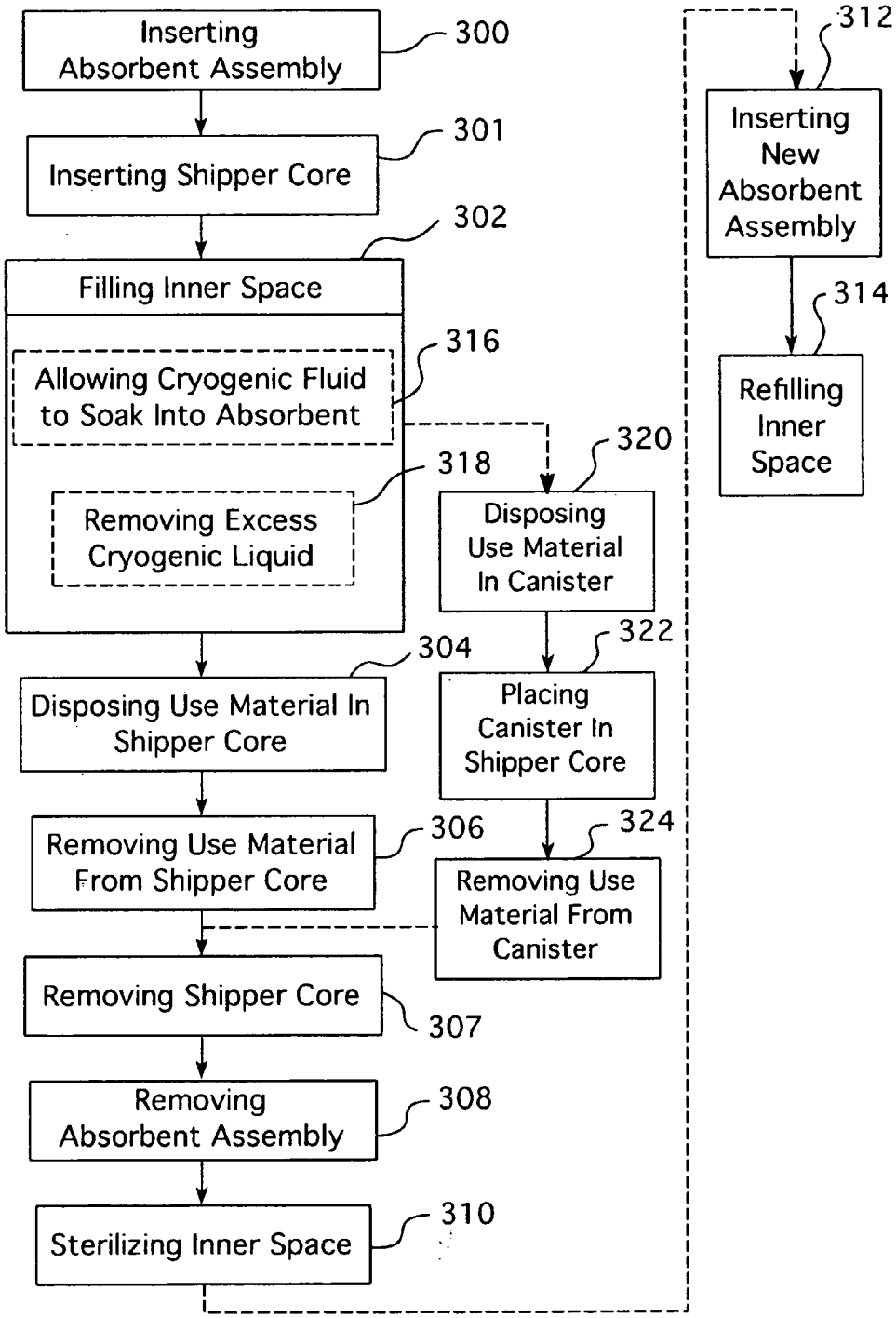
FIG. 5 is a flow chart of the method.

As shown in FIG. 4, in another alternate embodiment the absorbent assembly 260 includes a body 262 formed of removable absorbent elements 264 that are identical rigid members 265. In this embodiment, the inner shell assembly body 242 and the neck 32 have the same diameter. This configuration maximizes the spacing between the outer shell assembly body 222 and the inner shell assembly body 242. In this embodiment, the shipper core 250 has a diameter that is smaller than the diameter of the inner shell assembly body 242, thereby creating the annular space 274A. Again, the absorbent assembly body 262 is disposed in the annular space 274A. However, because the axial end of the absorbent assembly body 262 is exposed and accessible, all rigid members 265 are shaped as elongated, truncated wedges with a generally circular outer edge and a generally circular inner edge.

The sample containers 52 may be disposed in a canister 53 having a handle 55. The canister 53 is sized to fit within the shipper core 50 and is a tube having a closed lower end. The canister handle 55 extends upwardly from the canister 53 and, when placed in a shipper core 50 that is disposed in the inner space 44, the handle 55 extends through the neck 32. In this configuration, the handle 55 may be grasped by a user (who is wearing protective gloves) or the handle 55 may be coupled to the insulated cap 34. Thus, a user may lift the canister 53, and the sample containers 52 disposed therein, by lifting the insulated cap 34, if the handle 55 is coupled thereto, or by utilizing the handle 55. Additionally, for smaller sample containers 52, canes 56 may be utilized. A cane 56 is, essentially, a hollow tube in which small sample containers 52 may be placed. One or more canes 56 may then be disposed in a shipping core 50 or a canister 53.

Because the absorbent assembly 60, 160, 260 may be removed, the shipping container 10 may be sterilized and reused. That is, the method of using the shipping container 10 includes the steps of inserting 300 removable absorbent assembly 60, 160, 260 into a shipping container inner space 44, inserting 301 a shipper core 50 into the inner space 44, filling 302 the inner space with a cryogenic liquid, disposing 304 a use material in the shipper core 50 for a period of time, removing 306 the use material from said absorbent assembly shipping core 50, removing 307 the shipper core 50, removing 308 the absorbent assembly 60, 160, 260 from the inner space 44, and sterilizing 310 the inner space of said inner shell assembly body 42. After sterilization 310, the shipping container 10 may be prepared for reuse by inserting 312 a different removable absorbent assembly 60, 160, 260 into the inner space 44. The shipping container 10 may be reused by refilling 314 the inner space 44 with a cryogenic liquid. The step of filling 302 the inner space with a cryogenic liquid, or the step of refilling 314 the inner space 44 with a cryogenic liquid, may include the additional steps of allowing 316 the cryogenic liquid to be absorbed by the absorbent assembly 60, 160, 260, and removing 318 any excess cryogenic liquid. If a canister 53 is used, the method also includes the steps of placing 320 a use material in a canister 53, placing 322 the canister 53 in the shipper core 50, and removing 324 the canister from the shipper core 50.

While specific embodiments of the invention have been described in detail, it will be appreciated by those skilled in the art that various modifications and alternatives to those details could be developed in light of the overall teachings of the disclosure. For example, the second, inner shell assembly 40 may have a different shape, such as spherical or rectangular. A change in the shape of the inner space 44 will accommodate absorbent elements 64 having different shapes. Accordingly, the particular arrangements disclosed are meant to be illustrative only and not limiting as to the scope of invention which is to be given the full breadth of the claims appended and any and all equivalents thereof.

What is claimed is:

1. A shipping container comprising:

a first, outer shell assembly having a body defining an enclosed space and having an opening;

a second, inner shell assembly having a body defining an inner space and having an opening;

said second, inner shell assembly coupled to said first, outer shell assembly at said first, outer shell assembly opening, said second, inner shell assembly generally disposed within, and spaced from, said first, outer shell assembly, thereby forming a plenum within said enclosed space;

said first, outer shell assembly opening and said second, inner shell assembly opening forming a passage into said inner shell assembly space;

a removable shipper core disposed within said inner space, said shipper core having a cross-sectional area that is smaller than said second, inner shell assembly body so that, when said shipper core is disposed in said second, inner shell assembly body, there is an annular space between said shipper core and said inner shell assembly body;

an absorbent assembly formed by a plurality of removable absorbent assembly elements; and wherein said absorbent assembly elements are sized to pass through said passage and be disposed in said annular space.

2. The shipping container of claim 1 wherein said first, outer shell assembly body and said second, inner shell assembly body are made from a sterilizable material.

3. The shipping container of claim 1 wherein said absorbent assembly elements are structured to absorb a cryogenic liquid.

4. The shipping container of claim 1 wherein said absorbent assembly elements include fumed silica.

5. The shipping container of claim 1 wherein said absorbent assembly elements are socks filled with granular fumed silica.

6. The shipping container of claim 5 wherein said socks include a flexible covering.

7. The shipping container of claim 1 wherein:

said second, inner shell assembly body is elongated and said second, inner shell assembly opening is at one end of the second, inner shell assembly longitudinal axis; and said absorbent assembly elements are elongated rigid members structured to be disposed generally parallel to the longitudinal axis of said second, inner shell assembly.

8. The shipping container of claim 7 wherein said rigid members are shaped to form a cavity disposed generally along the longitudinal axis of said second, inner shell assembly.

9. The shipping container of claim 7 wherein:

said second, inner shell assembly body is generally cylindrical; and said rigid members generally have a cross-sectional shape of a truncated wedge with a generally circular outer edge and a generally circular inner edge.

10. The shipping container of claim 9 wherein:

said first, outer shell assembly body is generally cylindrical having a first diameter;

said second, inner shell assembly body has a diameter that is smaller than said first, outer shell assembly body diameter; and said shipper core is cylindrical having a diameter that is smaller than said second, inner shell assembly diameter.

11. The shipping container of claim 10 wherein said shipper core is generally an elongated, hollow cylinder.

12. The shipping container of claim 1 wherein said first, outer shell assembly includes a cap, said cap structured to cover and seal said passage.

* * * * *